US008443867B2

(12) United States Patent
Ishihara

(10) Patent No.: US 8,443,867 B2
(45) Date of Patent: May 21, 2013

(54) CASTING METHOD AND CASTING DEVICE FOR CAST-METAL OBJECT

(75) Inventor: Yasuyuki Ishihara, Kodaira (JP)

(73) Assignee: Bridgestone Corporation, Tokyo (JP)

( * ) Notice: Subject to any disclaimer, the term of this patent is extended or adjusted under 35 U.S.C. 154(b) by 0 days.

(21) Appl. No.: 13/518,998

(22) PCT Filed: Dec. 14, 2010

(86) PCT No.: PCT/JP2010/072441

§ 371 (c)(1),
(2), (4) Date: Jun. 25, 2012

(87) PCT Pub. No.: WO2011/081016

PCT Pub. Date: Jul. 7, 2011

(65) Prior Publication Data

US 2012/0279673 A1 Nov. 8, 2012

(30) Foreign Application Priority Data

Dec. 28, 2009 (JP) ..... 2009-297667

(51) Int. Cl.

| | |
|---|---|
| ***B22D 27/15*** | (2006.01) |
| ***B22D 18/06*** | (2006.01) |
| ***B22C 9/12*** | (2006.01) |
| ***B22C 5/12*** | (2006.01) |
| ***B22C 7/04*** | (2006.01) |

(52) U.S. Cl.
USPC ..... 164/47; 164/63; 164/160.1; 164/192; 164/243; 164/257

(58) Field of Classification Search
USPC ..... 164/47, 61, 63, 160.1, 192, 235–246, 164/253–257, 322
See application file for complete search history.

(56) References Cited

U.S. PATENT DOCUMENTS 5,072,773 A * 12/1991 Ruff et al. ..... 164/127

FOREIGN PATENT DOCUMENTS

| | | |
|---|---|---|
| JP | A-61-119350 | 6/1986 |
| JP | A-5-84448 | 4/1993 |
| JP | A-9-314284 | 12/1997 |
| JP | A-2002-45943 | 2/2002 |
| JP | A-2008-296228 | 12/2008 |

OTHER PUBLICATIONS

International Search Report issued in International Patent Application No. PCT/JP2010/072441 dated Mar. 8, 2011.

* cited by examiner

*Primary Examiner* — Kevin P Kerns
*Assistant Examiner* — Steven Ha
(74) *Attorney, Agent, or Firm* — Oliff & Berridge, PLC

(57) ABSTRACT

A casting method and a casting device for a cast-metal object which are inexpensive and have a high degree of freedom are provided to cast plural types of cast-metal objects simultaneously.

A cast-metal object is cast by using a casting device (10) including a mold structure (5) for forming a casting space capable of filling molten metal; and a runner (1) provided separately from the mold structure (5) for supplying molten metal into the casting space in the mold structure (5) by connecting the runner to the mold structure (5), wherein the runner (1) has a dividable structure, and the mold structure (5) has an assembly structure of a plurality of members.

5 Claims, 4 Drawing Sheets

Fig.2 ( a )
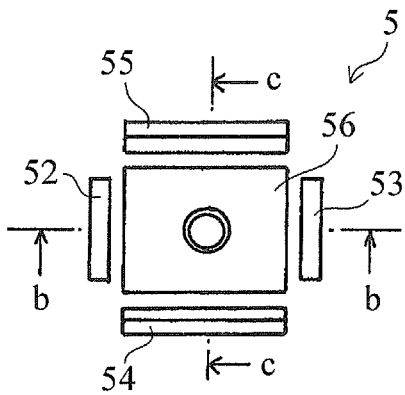
Fig.2 ( b )
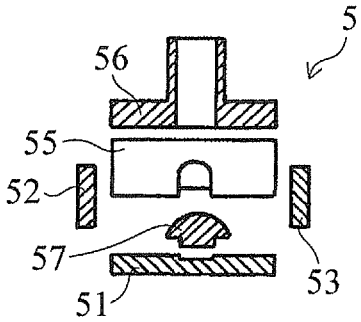
Fig.2 ( c )
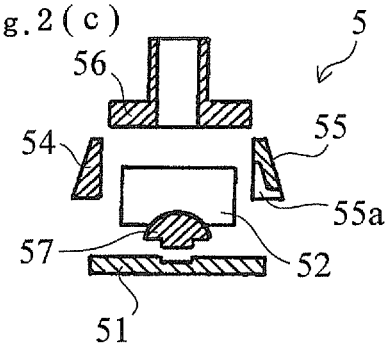

Fig.3 ( a )
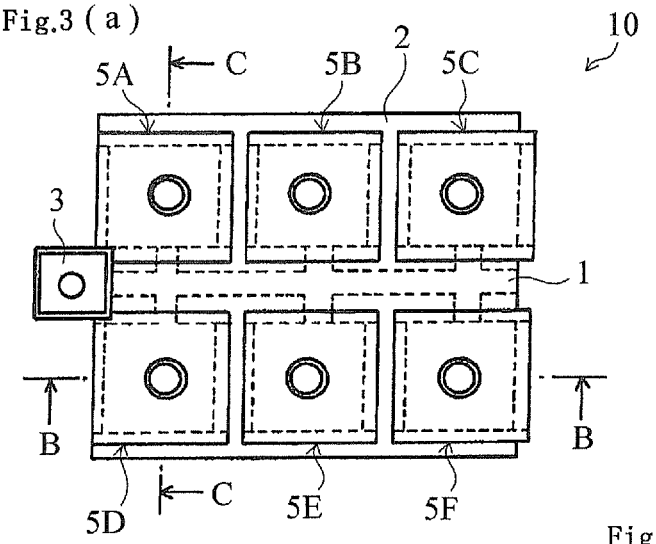
Fig.3 ( b )
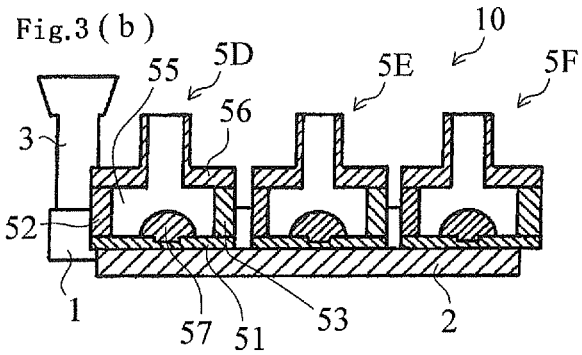
Fig.3 ( c )
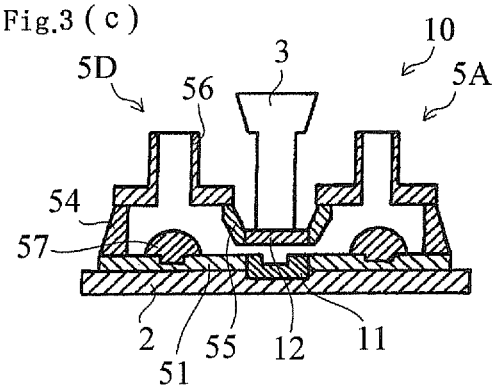
Fig. 4 ( a )
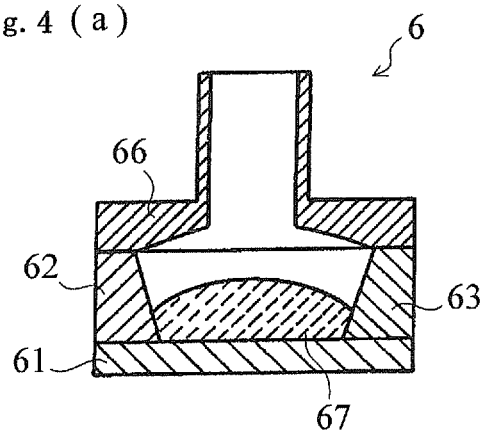
Fig. 4 ( b )
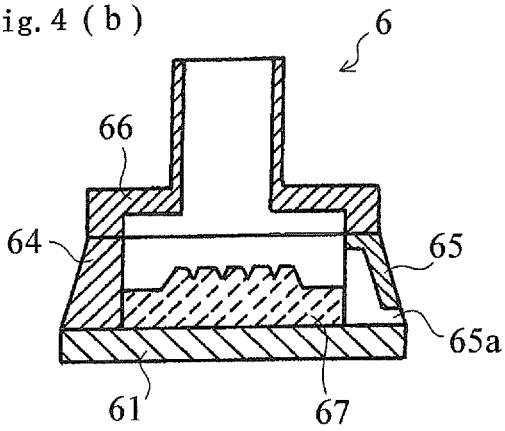

CASTING METHOD AND CASTING DEVICE FOR CAST-METAL OBJECT

TECHNICAL FIELD

The present invention relates to a casting method and a casting device for a cast-metal object. More particularly, the present invention relates to a technique of casting a plurality of cast-metal objects by one runner at one casting operation.

BACKGROUND ART

A casting method of casting a plurality of cast-metal objects simultaneously by one casting operation is widely used. In a general casting method, cavity portions for casting a plurality of cast-metal products and a runner portion for supplying molten metal to each of the cavity portions are formed continuously in one mold structure as a casting frame or mold. By using this casting device, molten metal is supplied from the runner portion to the plurality of cavity portions.

As such a method of casting a plurality of cast-metal objects simultaneously, there are a gravity casting mold and a mold casting structure (Patent Document 1). A tree-like wax model for lost wax casting is known (Patent Document 2). A die casting method and device are known (Patent Document 3). Even a low-pressure casting method may cast a plurality of cast-metal objects by one casting operation.

RELATED ART DOCUMENTS

Patent Documents

Patent Document 1: Japanese Unexamined Utility Model Application Publication No. 05-084448 (FIG. 1)

Patent Document 2: Japanese Unexamined Patent Application Publication No. 2002-045943 (claims)

Patent Document 3: Japanese Unexamined Patent Application Publication. No. 2008-296228

SUMMARY OF THE INVENTION

Problems to be Solved by the Invention

In the casting method as mentioned above using a casting device in which the runner portion and cavity portion are formed in one mold structure (casting mold, casting frame), there are the following problems.

Since it is necessary to form the runner portion and cavity portion in one mold structure, it is necessary to form a new mold structure including the runner portion for each cast-metal type such as the shape of cast-metal objects to be manufactured.

Since one mold structure has a particular number of cavity portions, even when the number of cast-metal objects to be cast is smaller than the particular number, it is necessary to cast the cast-metal objects same number as the particular number, making cast-metal objects more than necessary.

The present invention advantageously solves the above-mentioned problems by providing a casting method for a cast-metal object and a casting device using the casting method which are inexpensive and have a high degree of freedom.

Means for Solving the Problem

A casting method for a cast-metal object of the present invention comprises casting a cast-metal object by using a casting device including a mold structure for forming a casting space allowing molten metal be filled in and a runner provided separately from the mold structure for supplying molten metal into the casting space in the mold structure by connecting the runner to the mold structure, wherein the runner has a dividable structure, and the mold structure has an assembly structure of a plurality of members.

By providing a plurality of mold structures to be connected to the runner, a plurality of cast-metal objects may be cast simultaneously.

It is preferable that the runner is made of non-destructive material, the mold structure is made of non-destructive material, and at least a partial member constituting the mold structure is made of destructive material.

Further, the member made of the destructive material may have a through hole for guiding a portion of molten metal moving from the runner to the casting space of the mold structure and for introducing molten metal from a different position from the runner to the casting space.

When a number of same cast-metal objects are formed simultaneously, the objects are cast under different conditions for each mold structure.

The casting device for a cast-metal object of the present invention comprises: a mold structure for forming a casting space allowing molten metal be filled in and a runner provided separately from the mold structure for supplying molten metal into the casting space in the mold structure by being connected to the mold structure, wherein the runner has a dividable structure, and the mold structure has an assembly structure of a plurality of members.

Effects of the Invention

According to the present invention, since the runner is provided separately from the mold structure, when the metal-cast object is to be changed, it is sufficient that only the mold structure is changed. The casting degree of freedom is therefore high, and a cast-metal object can be manufactured inexpensively. The present invention is therefore very significant in precise casting metal objects-manufacture.

BRIEF DESCRIPTION OF THE DRAWINGS

FIG. 2 is a schematic exploded view of a cavity module.

FIG. 3 is a schematic diagram of a casting device of the embodiment.

FIG. 4 is a schematic cross sectional diagram of a cavity module.

MODES FOR CARRYING OUT THE INVENTION

The first embodiment of the casting method for a cast-metal object of the present invention will now be described with reference to the accompanying drawings.

Figure 1:
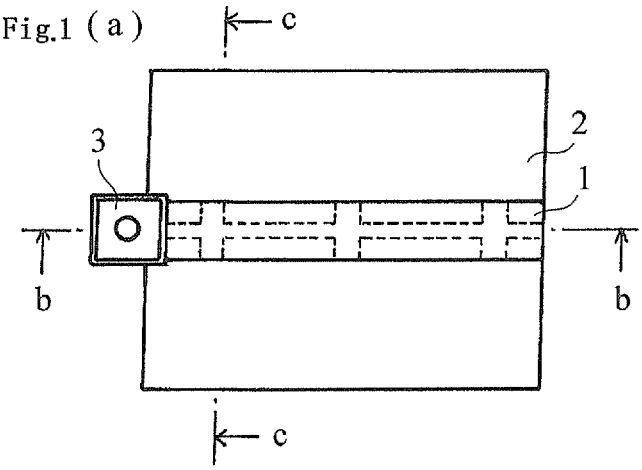
FIG. 1 is a schematic exploded view of a runner.
Figure 1:
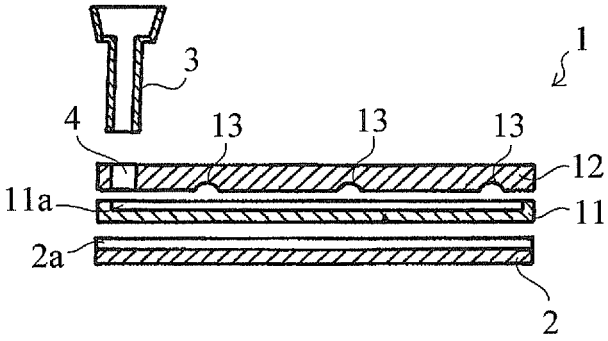
Figure 1:
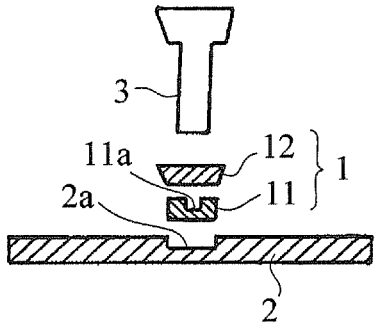

FIG. 1 is an exploded diagram of a runner 1 constituting the casting device to be used by the casting method of the first embodiment of the present invention. FIG. 1(*a*) is a schematic plan view of the runner 1, FIG. 1(*b*) is a cross sectional view taken along line b-b in FIG. 1(*b*), and FIG. 1(*c*) is a cross sectional view taken along line c-c in FIG. 1(*a*). The runner 1 illustrated in FIG. 1 is constituted of a dividable structure of a runner lower portion 11 formed with a groove along which molten metal flows and a runner upper portion 12 formed above the runner lower portion 11, and is fixed by being fitted in a groove 2*a* of a surface plate 2. A sprue 4 is provided at one end of the runner 1 in a longitudinal direction being capable of connecting a shoot 3 for guiding molten metal to the runner 1. An opening 13 is formed on the side wall of the runner 1, corresponding to a cavity module 5 to be described in the following with reference to FIG. 2. Molten metal is guided from the opening 13 to the cavity module 5 connected to the runner 1.

FIG. 2 is a schematic exploded diagram of a cavity module 5 as a mold structure constituting a casting device to be used by the casting method of the first embodiment of the present invention. FIG. 2(*a*) is a schematic plan view of the cavity module 5, FIG. 2(*b*) is a cross sectional view taken along line b-b in FIG. 2(*b*), and FIG. 2(*c*) is a cross sectional view taken along line c-c in FIG. 2(*a*). The cavity module 5 illustrated in FIG. 2 is an example of a cavity module to be used in gravity casting, and includes a finishing frame 51 formed on the surface plate 2, casting frames 52 to 55 mounted upright on the finishing frame 51 and surrounding square areas, feeder frame 56 mounted on the upper portion of the casting frames 52 to 55, and a mold 57 placed in a space surrounded by the casting frames 52 to 55 and giving a shape of a particular portion of the cast-metal to be cast. An opening portion 55*a* connected to an opening 13 of the runner 1 is formed in the casting frame 55. Molten metal is introduced into a cavity in the casting frames 52 to 55 from the opening portion 55*a*.

In FIG. 3, a casting device 10 formed by combining the runner 1 illustrated in FIG. 1 and the cavity module 5 illustrated in FIG. 2 is illustrated as a schematic plan view (FIG. 3(*a*)), a cross sectional view taken along line b-b in FIG. 3(*a*) (FIG. 3(*b*)), and a cross sectional view taken along line c-c in FIG. 3(*a*) (FIG. 3(*c*)). In FIG. 3, for the same member as illustrated in FIG. 1 and FIG. 2, the same symbol is assigned. In the following, an explanation which is duplicated with the explanation which has been already described will be omitted.

The casting device 10 illustrated in FIG. 3 has in total six cavity modules 5A to 5F placed on a surface plate 2. These cavity modules 5A to 5F each have the same structure as that of the cavity module 5 illustrated in FIG. 2. The cavity modules 5A to 5F are disposed symmetrically with respect to a runner 1, and openings 13 of the runner 1 and opening portions 55*a* of each cavity module casting frame 55 are aligned in position and disposed along a flow path of the runner 1.

In this embodiment structure, the runner 1 for casting is provided separately from the cavity modules 5A to 5F. The opening 13 of the runner 1 is connected to the opening portion 55*a* of the casting frame 55 of the runner 1 or cavity module 5A to 5F. If it becomes necessary to change the runner 1 or cavity module 5A to 5F, it is sufficient if only the runner 1 or cavity module 5A to 5F is replaced with. It is therefore unnecessary to form a new mold structure including the runner portion as conventional, and it is possible to use the runner 1, cavity module 5A to 5F repetitively.

It is possible to form a cavity module 5 having a different casting space without changing the structure of the runner 1. It is therefore possible to cast a variety of metal-cast objects with a minimum cost.

It is possible to connect a plurality of cavity modules 5 having the same structure excepting different casting spaces for different molds 57 to the runner 1, so that cast-metal objects of a variety type may be cast simultaneously.

Further, any one of the cavity modules 5A to 5F may be connected to the runner 1. As illustrated in FIG. 3, six cavity modules 5A to 5F in total may be connected to the runner 1. By connecting a plurality of cavity modules to the runner 1, a plurality of cast-metal objects can be cast simultaneously. The cases where a plurality of cavity modules are connected to the runner 1 are not limited to the case where six cavity modules in total are connected to the runner 1, and two to five modules may be connected to the runner 1 as long as the modules are capable of being mounted on a surface plate 2 and being connected to runner 1.

The number of cast-metal objects can be adjusted by increasing and decreasing the number of cavity modules attached to the runner 1. That is, by connecting required number of cavity modules 5 to the runner 1 for casting, the number of cast-metal objects to be casted can be adjusted. Conventional excessive cast-metal objects are not to be cast. The number of casting can be increased or decreased by increasing or decreasing the number of cavity modules attached to the runner 1, as well as by attaching a detachable lid to the opening 13 of the runner 1.

The runner 1 has a divisional structure of the lower runner portion 11 and an upper runner portion 12. The cavity module 5 has an assembly structure of a plurality of members, i.e., a finishing frame 51, casting frames 52 to 55, a feeder frame 56, and a casing 57. Dismount after casting is therefore easy, and recasting is also possible after dismount by resetting each member.

It is preferable to form a slanted portion (release gradient) to facilitate the dismount even after casting contraction on a groove 11*a* of the runner 1, casting frame 55 and opening portion 55*a* and runner upper portion 12.

Although not shown in FIGS. 1 to 3, a gate for locally squeezing the cross-sectional area of the flow path of the runner 1 may set at an inner position of the runner 1. It is therefore possible to absorb casting contraction of the runner at the gate position to destruct spontaneously and reduce excessive stress generation by casting contraction.

The inner faces of the runner 1 and casting frames 55A to 55F may be coated with a heat insulation sheet. By this, molten metal flow is secured and control of cast-metal object directional solidification is facilitated.

The cavity module 5 as a mold structure may be made of non-destructive material. Typical non-destructive material may be a variety of steel material, nickel alloy material and ceramic material.

The second embodiment of the present invention will be described. In this embodiment, at least a partial member constituting the cavity module is made of destructive material.

FIG. 4 is a schematic cross sectional view of a cavity module 6 having the partial member of this type made of non-magnetic material. FIG. 4(*a*) and FIG. 4(*b*) are vertical cross sectional views taken along mutually perpendicular cross lines. This cavity module 6 is an example of a cavity module to be used by gravity casting, and includes a finishing frame 61 formed on the surface plate 2, casting frames 62 to 65 mounted upright on the finishing frame 61 and surrounding square areas, feeder frame 66 mounted on the upper portion of the casting frames 62 to 65, and a casting mold 67 placed in a space surrounded by the casting frames 62 to 65 and giving a shape of a particular portion of the cast-metal to be cast. The cavity modules 6 are connected to the runner 1 in place of the cavity modules 5A to 5F illustrated in FIG. 3 to constitute a casting device. An opening portion 65*a* connected to an opening 13 of the runner 1 is formed in the casting frame 65 of the cavity module 6. Molten metal is introduced into a cavity in the casting frames 62 to 65 from the opening portion 65*a* of the casting frame 65.

In this embodiment, of the constituent members of the cavity module 6, the casting mold 67 is made of non-destructive material. In a conventional casting device, the runner portion and cavity portion are integrally formed in one mold structure (casting mold, frame), it is therefore difficult to use a combination of a non-destructive mold (such as steel mold) and a destructive mold (such as a gypsum mold). In contrast, in this embodiment where the runner 1 and cavity module 6 are provided separately and the mold structure has an assembly structure of a plurality of members, part of constituent members of the cavity module 6, casting mold 67, may be made of non-destructive material.

In this embodiment, since the casting mold 67 is made of non-destructive material, it is possible to form an undercut shape (reverse release gradient) on a metal-cast object so that the degree of freedom of the shape of a cast-metal object to be cast is improved remarkably.

In FIG. 4, although the casting frames 62 to 65 have shapes different from those of frames 52 to 55, the shapes are not limited thereto, but the casting frames 62 to 65 may have shapes similar to those of the casting frames 52 to 55, and the shape of only the casting mold 67 may have a different shape.

Not only the casting mold 67, the casting frames 62 to 65 may be made of destructive material, of course.

A typical example of the destructive material is resin, water glass mixed sand, gypsum, and a variety of casting ceramic mold material.

In this embodiment, if the mold structure is made of destructive material, depending on the quality or casting conditions of the destructive material, air existing in the destructive material is expanded by casting input heat so that there is a risk of generating casting defects such as insufficient molten metal flow, kirai (blown) defect, and blow hole defect. In order to prevent casting defects, it is preferable to apply a negative pressure to a member made of different material. A method illustrated in FIG. 5 and in the following may be used.

Figure 5:
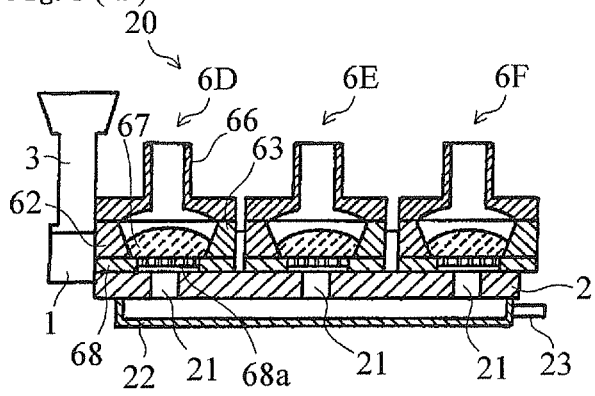
FIG. 5 is a schematic diagram of a casting device of an embodiment.
Figure 5:
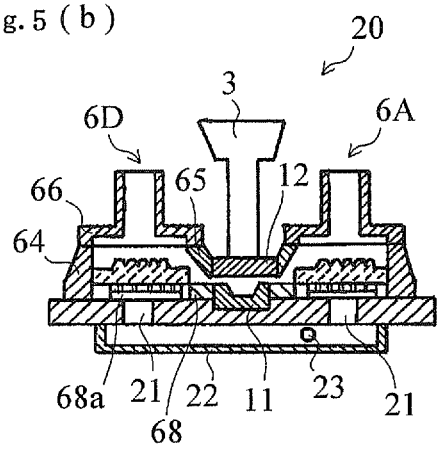

FIG. 5 is a schematic cross sectional view of a casting device 20 capable of applying a negative pressure. FIGS. 5(*a*) and 5(*b*) are vertical cross sectional views taken along lines mutually perpendicular. In FIG. 5, the same members as already described are represented by identical reference symbols, and the duplicate description thereof is omitted in the following.

In FIG. 5, cavity modules 6A to 6F are connected to a runner 1 in place of the cavity modules 5A to 5F illustrated in FIG. 3 to constitute a casting device 20. A surface plate 2 mounting the runner 1 has suction holes 21 corresponding to the cavity modules 6A to 6F. A reduced pressure chamber 22 is mounted under the surface plate 2. A reduced pressure chamber 22 is provided with an air exhaust hole 23 to be connected to an unrepresented air exhaust device.

Of the constituent members of the cavity modules 6A to 6F, the finishing frame 68 has air suction holes 68*a* extending through in a thickness direction. Constituent members other than the finishing frame 68 have the same structure as that of the cavity module 6 illustrated in FIG. 4.

In the casting device 20 illustrated in FIG. 5, a negative pressure is formed in a reduced pressure chamber 22 through air exhaust by an air exhaust device (not shown) to be connected to an air exhaust hole 23, and a negative pressure is formed in the air suction hole 21 of the surface plate 2 and an air suction hole 68*a* of the finishing frame 68 respectively communicating with the reduced pressure chamber 22. A negative pressure is therefore possible to be applied to a casting mold 67 in contact with the suction holes 68*a* of the finishing frame 68 without a reduced pressure atmosphere of the whole runner 1 and cavity modules. It is possible therefore to reduce casting defects.

Next, the third embodiment of the present invention will be described. In this embodiment, a member made of destructive material has a through hole for guiding a portion of molten metal moving from the runner to the casting space of the mold structure to guide the molten metal from a position different from the runner to the casting space.

Figure 6:
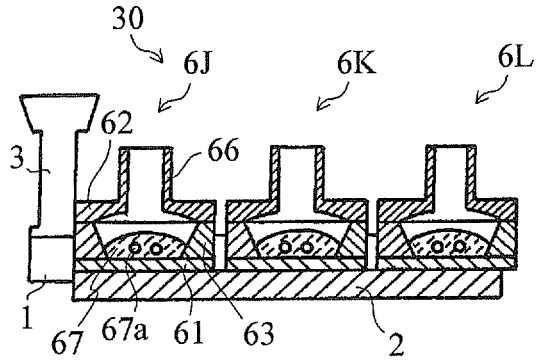
FIG. 6 is a schematic diagram of a casting device of another embodiment.
Figure 6:
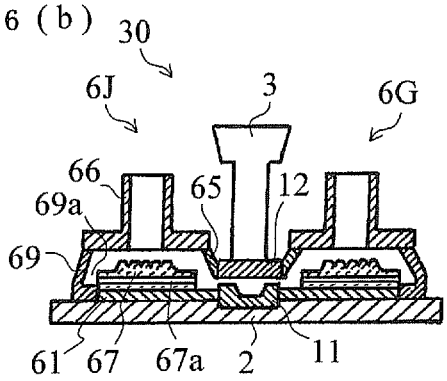

FIG. 6 is a schematic cross sectional view of a casting device 30 whose casting mold 67 made of destructive material has through holes 67*a*. The cross sectional views 6(*a*) and 6(*b*) are taken along lines mutually perpendicular. In FIG. 6, the same members as already described are represented by identical reference symbols, and the duplicate description thereof is omitted in the following.

In FIG. 6, cavity modules 6G to 6L are connected to a runner 1 in place of the cavity modules 5A to 5F illustrated in FIG. 3 to constitute a casting device 30. Of the constituent elements of the cavity modules 6G to 6L, a casting mold 67 has through holes 67*a* for guiding a portion of molten metal moving from the runner 1 into the casting space of each of the cavity modules, from another position of the runner 1 into the casting space. The casting frame 69 facing the casting frame 65 having an opening portion 65*a* is formed with a recess portion 69*a* to allow molten metal introduced from the through holes 67*a*. Constituent members other than the casting mold 67 and frame 69 have the same structures as those of the cavity modules 6 illustrated in FIG. 4.

The through holes 67*a* formed in the casting mold 67 made of destructive material are capable of directly connecting to the opening portion 65*a* of the casting frame 65 or the runner 1, and function as a tunnel structure (tunnel runner) capable of discharging molten metal from another position. By forming the through holes 67*a*, a new molten metal runner is formed in the casting mold 67. It is therefore possible to increase a molten metal flow rate into casting space per unit time and shorten a distance of molten metal running on the surface of the casting mold 67.

This advantage will be described in more detail. Molten metal filling into a cavity (casting space) is generally dependent largely on parameters including a position of a casting frame opening (gate), a length where molten metal runs on the surface of a cast mold, a molten metal flow rate per unit time, a molten metal temperature, a casting frame/mold temperature, a molten metal viscosity. If molten metal filling in a cavity is not sufficient for initial designs of a runner and gate, the runner structure has been often changed conventionally. With this method, however, there is a work of forming a new runner portion. When the runner has a design error, and an insufficient molten metal flow occurs because of the runner structure, which makes it difficult to fill molten metal in the cavity, in a conventional mold structure having the runner and cavities integrally, the runner structure itself is required to be changed by modifying the mold structure having the runner and cavities integrally even the cavity does not have a design error.

In a casting device 30 illustrated in FIG. 6, a runner structure is formed by through holes 67*a* in the casting mold 67 made of destructive material, so that the molten metal flow characteristics can be improved without changing the runner and casting frame considerably.

When the casting mold 67 does not have a through hole as a tunnel runner, at a position on the further side of the casting frame from the casting frame opening (gate), molten metal which flowed in both sides joins and may cause a cold shut defect or an insufficient molten metal flow defect at this position. In this embodiment, however, the casting mold 67 has a through hole 67*a* and the molten metal discharges from a position where cold shut defect and insufficient molten metal flow defect can be generated, and therefore, the generation of such casting defects can be effectively prevented.

In the casting device 30 illustrated in FIG. 6, as the casting device illustrated in FIG. 5, a suction hole 21 may be formed on the surface plate 2; a reduced pressure chamber 22 may be attached to the surface plate 2; and a finishing frame 68 of a cavity module may have suction holes 68*a* extending through in the thickness direction.

Next, the fourth embodiment of the present invention will be described. In this embodiment, when a number of same cast-metal objects are formed simultaneously, the objects are cast under different conditions for each mold structure. In the casting device illustrated in FIG. 3, this can be realized by casting under different casting conditions for the cavity modules 5A to 5F.

Generally, the setting of casting design of a cast-metal object includes a process of predicting the generation of casting defects by past casting results or molten metal flow and solidification simulation, a process of verifying the countermeasure against the casting defects to determine an optimum casting design. However, it is true that there exists a casting defect which cannot be verified without actually performing a casting test.

For the casting contraction of the cast-metal object, even an appropriate simulation software does not exist in the present state of the art. For this reason, the control of casting contraction of the cast-metal object by setting the contraction rate or controlling the casting conditions needs an actual casting test to obtain the precise parameters.

Further, a conventional mold structure has a plurality of cavities formed in one mold structure, and therefore, all of the plurality of cavities can be cast only in same conditions. By this, since it is necessary to perform a plurality of casting operations under varied conditions to optimize a preheating temperature of the mold, the setting of the heat capacity, cooling conditions or the like, it is necessary to perform a plurality of casting experiments to verify.

On the other hand, in this embodiment, such actual casting tests can be performed in minimum runs. More concretely, in this embodiment, since the cavities are modularized (each having an independent section) for each cavity such as cavity module 5A to 5F, main parameters which have an influence on the molten metal flow, solidification or cooling, such as the preheating temperature, the heat capacity, the thermal conductivity, the density of the casting mold and the cooling condition can be changed intentionally. By this, a plurality of parameter-change tests can be performed simultaneously by one casting test.

For example, as in FIG. 3, in the case of using a design in which six cast-metal objects are cast simultaneously in six cavity modules in one casting operation, a casting test is performed once by using different preheating temperature of the casting frame, quality of the casting frame material and weight of the casting frame (weight of a chill) for each of the cavity modules 5A to 5F; and the casting defect and dimensional accuracy performance of the corresponding cast-metal objects 1 to 6 are evaluated; whereby casting conditions which can optimize the casting defect and the dimensional accuracy performance in a product casting operation can be determined. In the case of such an example, compared to a conventional method in which six casting tests have to be performed, optimum casting conditions can be determined by minimum runs of casting tests.

EXAMPLES

Common Conditions

A casting operation for a mold for molding a tire made of aluminum alloy AC7A (Al-5% Mg alloy) was performed. For a casting device, the one in which six cavity modules in total having therein a casting space with the shape illustrate in FIG. 4 were disposed on the both side of the runner 1 as illustrated in FIG. 3 was used. The materials of the constituent members of the casting device were as follows: runner, surface plate, casting frame: S45C (carbon steel) runner and insulator at the gate portion: Nippon Steel Chemical Co., Ltd., 2 mm thickness SC paper 1260I sprue: Noritake G-6 non-foaming plaster shoot: SUS304 insulator in the shoot: Nippon Steel Chemical Co., Ltd., 5-inch SC sleeve casting mold: S45C (carbon steel) or Noritake G-6 non-foaming plaster cast-metal object material: aluminum alloy AC7A (Al-5% Mg alloy)

The casting operations of Examples 1 to 4 to be described in the following were all performed under air atmosphere by gravity casting (molten metal drop from a crucible; pouring method).

Example 1

Cavity modules and a runner under the above-mentioned common conditions were used; for the casting mold, non-destructive material S45C (carbon steel) was used; the preheating temperatures of a casting frame and a casting mold were set to 250° C.; and the casting starting temperature was set to 680° C., whereby a sound aluminum casting material for processing a mold for a tire could be manufactured.

About 90 minutes after completing casting, the cast-metal objects were dismounted, and the casting mold and casting frame were reset to allow the second casting operation of cast-metal objects. (It was not necessary to preheat the casting frame/mold again for casting).

Example 2

Cavity modules and a runner under the above-mentioned common conditions were used; for the casting mold, destructive material Noritake G-6 non-foaming plaster (casting mold dry density: 1.2 g/cm$^3$) was used; the preheating temperatures of a casting frame and a casting mold were set to 150° C.; the casting starting temperature was set to 680° C.; and by using a constitution illustrated in FIG. 5, a reduced pressure of 0.4 atm was applied to the casting mold during casting, whereby a sound aluminum casting material for processing a mold for a tire could be manufactured. Regarding the casted aluminum casting material for processing a mold for a tire, on the surface portion in contact with a casting frame which is furthest from a gate portion, a little cold shut was generated, although the cold shut was not a problem in product quality.

Example 3

Under roughly the same conditions as in Example 2, and in a state in which two through holes (tunnel runners) were formed inside the plaster casting mold as illustrated in FIG. 6, a sound aluminum alloy precise-casting cast-metal object for a mold for a tire could be obtained without a cold shut defect on the surface in contact with a casting frame of the cast-metal object.

Example 4

Cavity modules and a runner under the above-mentioned common conditions were used; for the casting mold, destructive material Noritake G-6 non-foaming plaster was used; the dimensional enlargement ratio of the plaster casting mold was set to 1.01368 (casting contraction ratio 13.5/1000); the casting starting temperature was set to 680° C.; by using a constitution illustrated in FIG. 5, a reduced pressure of 0.4 atm was applied to the casting mold during casting; and for six cavity modules 6A to 6F, the dry density of the casting mold and the preheating temperature of the casting/casting frame were varied for each cavity module as listed in Table 1 to perform a casting operation, whereby casting conditions under which the dimension of the cast-metal object was best were determined.

TABLE 1

| | |
|---|---|
| module 6A | casting mold dry density 1.2 g/cm$^3$<br>casting mold/frame preheating temperature 150° C. |
| module 6B | casting mold dry density 1.2 g/cm$^3$<br>casting mold/frame preheating temperature 180° C. |
| module 6C | casting mold dry density 1.2 g/cm$^3$<br>casting mold/frame preheating temperature 210° C. |
| module 6D | casting mold dry density 1.0 g/cm$^3$<br>casting mold/frame preheating temperature 150° C. |
| module 6E | casting mold dry density 1.0 g/cm$^3$<br>casting mold/frame preheating temperature 180° C. |
| module 6F | casting mold dry density 1.0 g/cm$^3$<br>casting mold/frame preheating temperature 210° C. |

For these cast-metal objects, the dimensional accuracy was evaluated. The casting contraction rate of the module 6A was the nearest to the set value, and unevenness of the shape of the design surface of the cast-metal object was small (average casting contraction rate: 13.8/1000, the amount of unevenness: 0.2 mm or smaller).

One casting test thus could narrow down optimum casting conditions.

DESCRIPTION OF SYMBOLS

| | |
|---|---|
| 1 | runner |
| 2 | surface plate |
| 3 | shoot |
| 4 | sprue |
| 5, 5A to 5F | cavity module |
| 6, 6A to 6G | cavity module |
| 11 | runner lower portion |
| 12 | runner upper portion |

-continued

| | |
|---|---|
| 21 | suction hole |
| 22 | reduced pressure chamber |

The invention claimed is:

1. A casting method of casting a cast-metal object which comprises:

casting a cast-metal object by using a casting device including:

a mold structure for forming a casting space allowing molten metal to be filled in, and a runner provided separately from the mold structure for supplying molten metal into the casting space in the mold structure by being connected to the mold structure, wherein:

the runner has a dividable structure, and the mold structure has an assembly structure of a plurality of members;

at least a partial member constituting the mold structure is made of destructive material; and the partial member made of the destructive material has a through hole for guiding a portion of molten metal moving from the runner to the casting space of the mold structure and for introducing molten metal from a different position from the runner to the casting space.

2. The casting method for a cast-metal object according to claim 1, wherein there are provided a plurality of mold structures to be connected to the runner to cast a plurality of cast-metal objects simultaneously.

3. The casting method for a cast-metal object according to claim 1, wherein the runner is made of non-destructive material and the mold structure is made of non-destructive material.

4. The casting method for a cast-metal object according to claim 2, wherein when a number of same cast-metal objects are formed simultaneously, the objects are cast under different conditions for each mold structure.

5. A casting device for a cast-metal object comprising:

a mold structure for forming a casting space allowing molten metal to be filled in; and a runner provided separately from the mold structure for supplying molten metal into the casting space in the mold structure by being connected to the mold structure, wherein:

the runner has a dividable structure, and the mold structure has an assembly structure of a plurality of members;

at least a partial member constituting the mold structure is made of destructive material; and the partial member made of the destructive material has a through hole for guiding a portion of molten metal moving from the runner to the casting space of the mold structure and for introducing molten metal from a different position from the runner to the casting space.

* * * * *